US012721484B2

(12) United States Patent
Amano

(10) Patent No.: US 12,721,484 B2
(45) Date of Patent: Sep. 1, 2026

(54) TOILET PAPER ROLL

(71) Applicant: Daio Paper Corporation, Ehime (JP)

(72) Inventor: Yoshimi Amano, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 225 days.

(21) Appl. No.: 18/580,386

(22) PCT Filed: Mar. 10, 2022

(86) PCT No.: PCT/JP2022/010725
§ 371 (c)(1),
(2) Date: Jan. 18, 2024

(87) PCT Pub. No.: WO2023/053494
PCT Pub. Date: Apr. 6, 2023

(65) Prior Publication Data

US 2024/0324829 A1 Oct. 3, 2024

(30) Foreign Application Priority Data

Sep. 30, 2021 (JP) ..... 2021-161609

(51) Int. Cl.
*A47K 10/16* (2006.01)
*D21H 27/30* (2006.01)

(52) U.S. Cl.
CPC ..... *A47K 10/16* (2013.01); *D21H 27/30* (2013.01); *Y10T 428/15* (2015.01)

(58) Field of Classification Search
CPC ..... A47K 10/16; D21H 27/30; Y10T 428/15
See application file for complete search history.

(56) References Cited

FOREIGN PATENT DOCUMENTS

| | | | | |
|---|---|---|---|---|
| JP | 2002-345676 | A | | 12/2002 |
| JP | 2003-199687 | A | | 7/2003 |
| JP | 2009039308 | A | * | 2/2009 |
| JP | 6021532 | B2 | | 11/2016 |
| JP | 2019-010366 | A | | 1/2019 |
| JP | 2020084361 | A | * | 6/2020 |
| JP | 2020179013 | A | * | 11/2020 |

OTHER PUBLICATIONS

[NPL-1] Yasunobu et al. (JP 2020-179013 A); Nov. 5, 2020 (European Patent Office machine translation to English). (Year: 2020).*
[NPL-1] Koichi (JP 2020-084361 A); Jun. 4, 2020 (European Patent Office machine translation to English). (Year: 2020).*
[NPL-3] Koji (JP 2009-039308 A); Feb. 26, 2009 (European Patent Office machine translation to English). (Year: 2009).*

* cited by examiner

*Primary Examiner* — Donald M Flores, Jr.
(74) *Attorney, Agent, or Firm* — Renner, Kenner; Arthur M. Reginelli

(57) ABSTRACT

Provided is a toilet paper roll which is fit for a longer toilet paper suitable for use for toilets with washing function. The toilet paper roll includes a paper core and 2-ply toilet paper wound thereon, wherein the toilet paper roll has a roll diameter of 120 mm or smaller, a roll winding density of 0.74 to 1.30 m/cm$^2$, and a roll density of 0.12 to 0.18 g/cm$^3$.

5 Claims, 3 Drawing Sheets

TOILET PAPER ROLL

FIELD OF ART

The present invention relates to a toilet paper roll.

BACKGROUND ART

With widespread of toilets with washing function, toilet papers have been demanded to suit the use for toilets with such washing function.

When using a toilet with washing function, the user washes his body site pertaining to defection or urination with water or warm water, and then needs to wipe off feces and urine together with the washing water remaining on the skin.

Thus, toilet paper is expected to be capable of wiping off a quantity of water remaining on the skin, highly water-absorbent, and to provide a sense of security in the wiping. In this regard, as a technique for enhancing the capability of wiping off water remaining on the skin, or the like, laminate embossing technique is known. Laminate embossing is to laminate embossed plies with an adhesive glue for enhancing strength, thickness, and water penetration suppression effect.

On the other hand, toilet paper is commercially available in the form of a toilet paper roll, in which toilet paper is wound on a paper core. Recently, the length of toilet paper wound on a paper core in a toilet paper roll has been becoming longer.

PRIOR ART PUBLICATION

Patent Publication

Patent Publication 1: JP 6021532 B2
Patent Publication 2: JP 2019-10366 A

SUMMARY OF THE INVENTION

Problems to be Solved by the Invention

Toilet paper produced through the laminate embossing, however, tends to result in too large a paper thickness, and is thus not suitable as it is for longer roll products.

On the other hand, reduction in basis weight of each ply in compensation for the larger length may deteriorate texture, such as softness, fluffiness, and smoothness and, in particular, reduction in basis weight of toilet paper produced through the laminate embossing may result in crisp, coarse touch ascribable to the adhesive glue.

Further, when such toilet paper is made into a toilet paper roll, touch of the roll surface is not comfortable, which is likely to give the user a feel of firmness.

It is therefore an object of the present invention to provide a toilet paper roll which is suitable for a longer roll of toilet paper capable of wiping off water remaining on the skin, being highly water-absorbent, providing a sense of security in the wiping, and having sufficient texture, such as softness, fluffiness, and smoothness, and of which feel of robust firmness makes the user aware of a larger roll length, while giving excellently comfortable touch of the roll surface.

Means for Solving the Problem

The first means for solving the above problems is a toilet paper roll including a paper core and 2-ply toilet paper wound thereon, wherein the toilet paper roll has a roll diameter of 120 mm or smaller, a roll winding density of 0.74 to 1.30 m/cm$^2$, and a roll density of 0.12 to 0.18 g/cm$^3$.

The second means is the toilet paper roll according to the first means, wherein a degree of compaction of the toilet paper roll is 0.66 to 1.50.

The third means is the toilet paper roll according to the first or second means, wherein the toilet paper has first and second plies laminated together, the first ply having first and second recesses of different depths formed by embossing.

The fourth means is the toilet paper roll according to the third means, wherein the second ply has recesses formed by embossing, which have a smaller depth compared to the depth of the first recesses in the first ply.

The fifth means is the toilet paper roll according to any one of the first to fourth means, wherein an enzymatic paper strength agent has been acted on the toilet paper.

The sixth means is the toilet paper roll according to any one of first to fifth means, wherein the toilet paper is free of starch and cationized starch.

Effect of the Invention

According to the present invention, there is provided a toilet paper roll which is suitable for a longer roll of toilet paper capable of wiping off water remaining on the skin, being highly water-absorbent, providing a sense of security in the wiping, and having sufficient texture, such as softness, fluffiness, and smoothness, and of which feel of robust firmness makes the user aware of a larger roll length, while giving excellently comfortable touch of the roll surface.

MODES FOR CARRYING OUT THE INVENTION

Embodiments of the present invention will now be discussed in detail with reference to the attached drawings.

Figure 1:
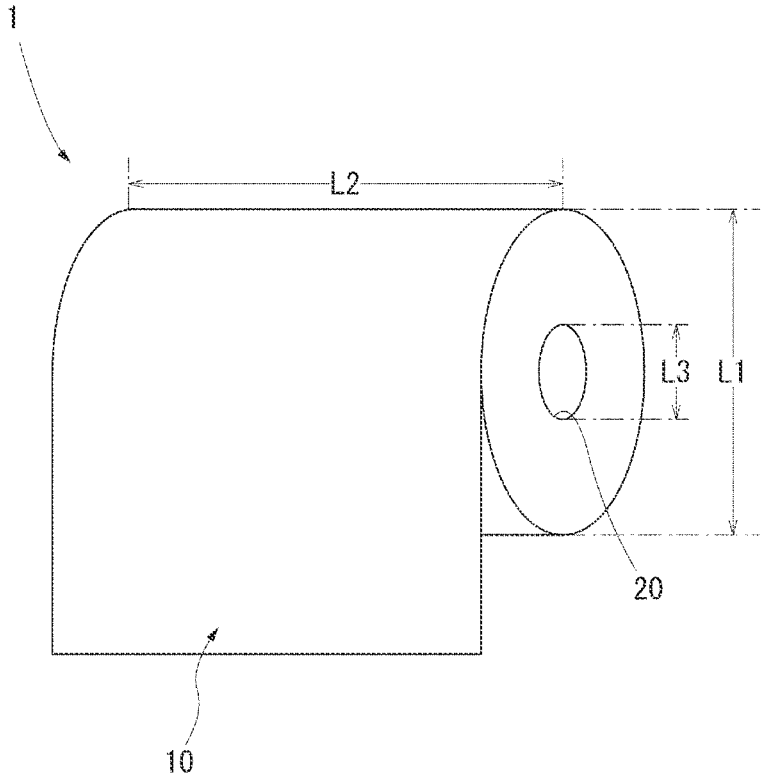
FIG. 1 is a perspective view of the toilet paper roll of an embodiment according to the present invention.

A toilet paper roll according to the present embodiment, as shown in FIG. 1, is cylindrical, and has a paper core (also referred to as a paper tube) 20 and toilet paper 10 wound thereon, wherein the toilet paper 10 is a 2-ply, water-disintegrable toilet paper having first and second plies laminated together. As used herein, being water-disintegrable means to have an easiness to loosen according to JIS P 4501 of 100 seconds or less.

2-Ply toilet paper rolls referred to as common products have a roll length of about 20 to 25 m, whereas the toilet paper rolls according to the present embodiment suitably have a roll length of 34.5 to 55 m, preferably 38 to 50 m, and are thus suitable for so-called longer roll products, 1.5- to 2-times longer roll products, or the like, provided that the roll length is not necessarily limited to the above.

The toilet paper roll according to the present embodiment has a roll diameter L1 (diameter) of 120 mm or less, preferably 107 to 119 mm. The roll diameters L1 of toilet paper rolls are provided in JIS P 4501 as 120 mm or less and, accordingly, holders for common toilet paper rolls are manufactured on the basis of this 120 mm diameter. The toilet paper rolls according to the present embodiment has a roll diameter of 120 mm or less, and thus may be put on the standard holders. Here, the roll diameter L1 refers to a value determined with DIAMETER RULE manufactured by MURATEC-KDS CORP. or an equivalent thereof. An average of values measured at three different locations along the width direction is taken as the measured value. The average value of the products within the same production lot refers to an average of five rolls. The roll width L2 of the toilet paper roll according to the present embodiment is not particularly limited, and may preferably be 100 to 130 mm. The outer diameter L3 of the paper core is also not particularly limited, and may be 34 to 42 ϕmm.

Here, the toilet paper roll according to the present embodiment characteristically has a roll winding density of 0.74 to 1.30 m/cm$^2$, and a roll density of 0.12 to 0.18 g/cm$^3$.

The roll winding density is expressed by ("Roll Length"*"Number of Plies")/"Cross-Sectional Area of the Roll". The "Cross-Sectional Area of the Roll" is expressed by "Cross-Sectional Area of the Roll over Roll Diameter (outer diameter) L1"−"Cross-Sectional Area over Outer Diameter L3 of Paper Core". Therefore, for example, when a roll is 2-ply and has a roll length of 46 m, a roll diameter L1 of 115 mm, and an outer diameter L3 of the paper core of 38 mm, the roll winding density is (46 m*2)/{3.14*(115 mm/2/10)$^2$−3.14*(38 mm/2/10)$^2$}=0.99 m/cm$^2$.

The roll density is expressed by "Mass of the Roll"/"Volume of the Roll". The "Mass of the Roll" refers to a mass of a toilet paper roll per 114 mm roll width. The Volume of the Roll" is expressed by ("Cross-Sectional Area of the Roll over Roll Diameter (diameter) L1"−"Cross-Sectional Area over Outer Diameter L3 of the Paper Core") *"Roll Width" (in terms of 114 mm). For example, when a roll has a mass per 114 mm roll width (exclusive of the paper core) of 152 g, a roll diameter L1 of 115 mm, and an outer diameter L3 of the paper core of 38 mm, the roll density is 152 g/[{3.14*(115 mm/2/10)$^2$−3.14*(38 mm/2/10)$^2$}*(114 mm/10)]=0.14 g/cm$^3$.

The roll winding density and the roll density are indices of how densely and tightly or loosely a toilet paper roll is wound. When the winding is too loose, the roll may be excessively deformable, so that, for example, the paper core and the vicinity thereof may fall out, whereas when the winding is too tight, the roll may give a feel of firmness when held in hand.

Further, the toilet paper roll according to the present embodiment may preferably have, in addition to the roll winding density and the roll density discussed above, a degree of compaction of 0.66 to 1.50.

The degree of compaction of a roll is expressed by "Cross-Sectional Area Calculated from Paper Thickness"/"Cross-Sectional Area of the Roll". The "Cross-Sectional Area of the Roll" may be calculated in a manner similar to the calculation of the "Cross-Sectional Area of the Roll" in calculating the roll winding density. The "Cross-Sectional Area Calculated from the Paper Thickness" is expressed by "Paper Thickness"*"Roll Length". In the value of the "Cross-Sectional Area Calculated from the Paper Thickness", gaps formed in winding the toilet paper on the paper core are not taken into consideration, whereas in the value of the "Cross-Sectional Area of the Roll", the gaps formed in winding the toilet paper on the paper core are taken into consideration. Consequently, the degree of compaction of the roll expressed by a ratio of "Cross-Sectional Area Calculated from the Paper Thickness" to "Cross-Sectional Area of the Roll" may be an index of how tightly or loosely a toilet paper roll is wound. As discussed above, when the winding is too loose, the roll may be excessively deformable, so that, for example, the paper core and the vicinity thereof may fall out, whereas when the winding is too tight, the roll may give a feel of firmness when held in hand. Note that the roll winding density tends to be affected by the number of plies, while the degree of compaction of a roll tends to be affected by the paper thickness.

Here, the feel of firmness of a toilet paper roll when held in hand is affected not only by the denseness of the roll, but also by collapse of the recesses in the toilet paper due to stretching and winding of the toilet paper, as well as the properties and surface characteristics of the toilet paper. Thus, still more preferred constitution of the toilet paper of a toilet paper roll according to the present embodiment will now be discussed.

Such preferred toilet paper is 2-ply toilet paper having recesses formed by embossing. The toilet paper has a basis weight per ply of preferably 13.0 to 17.0 g/m$^2$, more preferably 13.5 to 16.0 g/m$^2$, a paper thickness in 2 ply of preferably 175 to 238 μm, more preferably 180 to 225 μm. Within such ranges of basis weight and paper thickness, the toilet paper may provide sufficiently enhanced capability of wiping off water remaining on the skin, sufficiently enhanced water-absorbency, and sufficiently enhanced sense of security in the wiping, and may enhance the feel of the roll surface of a longer roll.

The basis weight is determined in accordance with JIS P 8124. The paper thickness is determined by subjecting a test piece to moisture conditioning under the conditions provided in JIS P 8111 (1998) sufficiently (usually for about 8 hours), and then measuring the thickness of the test piece as it is in two ply under the same conditions using a dial thickness gauge (thickness measuring device) PEACOCK Model H (manufactured by OZAKI MFG. CO., LTD.). Specifically, the dial thickness gauge is checked for any dust, dirt, and the like between the plunger and the anvil, the plunger is lowered onto the anvil, and the scale is moved to adjust the zero point. Next, the plunger is raised, a specimen is placed on the anvil, and then the plunger opened by 700 μm is lowered onto the specimen by pulling down the lever at a stroke, and the scale is read. Upon measurement, the plunger is merely placed on the specimen and is not pressed against it. The terminal of the plunger has a flat circular surface of 10 mm in diameter, which is brought into contact with the paper plane perpendicularly. The load for this measurement of paper thickness is about 70 gf. The average of ten measured values is taken as the paper thickness.

The first ply of the toilet paper according to the present embodiment preferably has first and second recesses of different depths formed by embossing. The first and second recesses in the first ply are formed on the same surface, whereas on the other surface of the toilet paper are preferably formed projections corresponding to the first and second recesses. Either of the first and second plies may face externally with respect to the paper core, and the first ply may preferably face externally, in particular, its surface having the recesses may preferably face externally.

In this toilet paper, the inner surface portion of the first ply in the laminate corresponding to the first recesses may be adhered to the inner surface the second ply in the laminate to form a 2-ply sheet. The adhesion may be made between the projections corresponding to the recesses in the first ply and the inner surface of the second ply in the laminate, by means of an adhesive applied to the projections. Alternatively, the first and second plies may be compressed and integrated by embossing, i.e., so-called single embossing. Regardless of whether an adhesive is used or not, or regardless of whether the single-embossing is employed or not, projections corresponding only to the first recesses in the first ply, or projections corresponding to the first and second recesses in the first ply, may be formed in the outer surface of the second ply through the lamination and integration of the first and second plies. On the other hand, it is preferred that the second recesses are not adhered on the inner surface of the first ply in the laminate to the second ply with an adhesive. All of the first recesses are not necessarily adhered on the inner surface of the first ply in the laminate to the second ply but, in consideration of possible separation of the plies, it is preferred that all of the first recesses are adhered to the second ply.

The adhesive, when used, may either be water-based or oil-based adhesive. Preferred are water-soluble adhesives, such as PVA (polyvinyl alcohol) or CMC (carboxymethyl cellulose). Particularly preferred is CMC, which is a cellulose-based, water-soluble adhesive.

Further, the adhesive itself may be an ink having adhesivity, or the adhesive may contain a coloring component, such as pigments or dyes, added thereto. In this case, the first recesses are colored and become visually observable, which improves the design. Preferred coloring components may be aqueous dyes, such as phthalocyanine dyes or azo metal complex dyes. The pigments may be aluminum hydroxide, kaolin, talc, calcium carbonate, titanium dioxide, clay, zinc oxide, or the like.

The shape in plan view of each of the first recesses and the second recesses, when provided, is not limited. In particular, the shape in plan view of each first dent is preferably decided taking the design or the like into consideration. The area of each of the first and second recesses is not necessarily limited, and recesses of plurality of different areas may be provided. For particularly facilitating production of the effects of the present invention to provide a toilet paper roll which is suitable for a longer roll of toilet paper particularly capable of wiping off water remaining on the skin, being highly water-absorbent, providing a sense of security in the wiping, and having sufficient texture, such as softness, fluffiness, and smoothness, and which provides a feel of robust firmness, while giving excellently comfortable touch of the roll surface, the area of each of the first recesses is preferably 1.00 to 22.0 $mm^2$, more preferably 1.50 to 21.5 $mm^2$, and the area of each of the second recesses is preferably 0.25 to 0.75 $mm^2$, more preferably 0.30 to 0.50 $mm^2$. Further, the density of the first and second recesses formed by embossing is not necessarily limited. For particularly facilitating production of the above-mentioned effects of the present invention, a preferred density of the first recesses formed by embossing is 4 to 14 recesses per square centimeter, more preferably 7 to 11 recesses per square centimeter, and a preferred density of the second recesses formed by embossing is 2 to 11 recesses per square centimeter, more preferably 5 to 8 recesses per square centimeter. Note that the density of the recesses formed by embossing is measured of a portion of the toilet paper over 50 cm from the end of the winding, exclusive of the tail seal.

In the toilet paper according to the present embodiment, preferably the depth of the first recesses is 0.17 to 0.23 mm and the depth of the second recesses is 0.050 to 0.090 mm. With the depths of the first and second recesses within these ranges, in combination with the features of the above-mentioned roll density and the roll winding density, the texture of the toilet paper and the texture of the roll surface are particularly improved.

Figure 2:
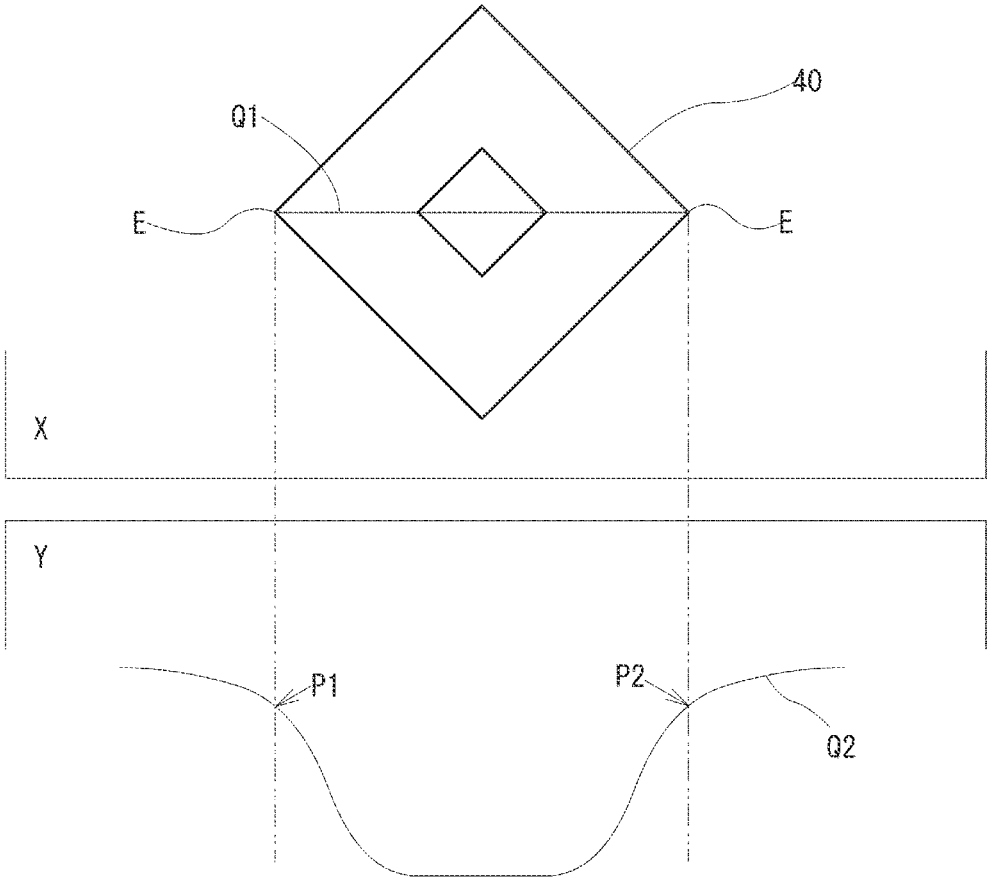
FIG. 2 is a schematic view for explaining the measurement procedure of the embossing depth according to the present invention.

The depths of the first and second recesses are measured using Wide-Area 3D Measurement Microscope VR-3200 manufactured by KEYENCE CORPORATION or an equivalent thereof and an image analysis software VR-H1A manufactured by KEYENCE CORPORATION or an equivalent thereof. The measurements are made at a magnification of 12 folds in the field of view of 24 mm by 18 mm, provided that the magnification and the area of the field of view may suitably be adjusted depending on the size of the recesses formed by embossing. Specific manner of measurement is explained with reference to FIG. 2. Using the above-mentioned software, the embossing depth profile (total profile) of one recess 40 in the image area shown in planar view (area X in the figure) is obtained along line Q1 crossing the peripheral edge of the recess 40 in its largest dimension part. From the primary profile of this embossing depth profile, the surface roughness components of the wavelength shorter than λc: 800 μm (provided that λc stands for "a filter defining the boundary of the roughness component and the waviness component" provided in 3.1.1.2 in JIS-B0601) are filtered out with a low-pass filter to obtain Profile Q2 indicated in the image area shown in cross-sectional view (area Y in the figure). On this profile Q2, two recess edge points P1, P2 where the profile Q2 is convexed upwards and curved most sharply are identified, and the minimum value between these recess edge points P1, P2 is determined and taken as the minimum value Min of depth. On the other hand, the average of the depth values at the recess edges P1, P2 is taken as the maximum value Max of depth. In this way, the formula, "Embossing Depth"="Maximum Value Max"−"Minimum Value Min", is obtained. Further, the distance (length) between the recess edge points P1, P2 in the X-Y plane is determined as the length of the largest dimension part. These two recess edge points P1, P2 where the profile Q2 is convexed upwards and curved most sharply, are visually selected. In selecting these points, the contour E of the recess 40 being measured, shown in the image in planar view may be referred to. Similarly, the depth of the recess is also measured in its smallest dimension part in the direction orthogonal to the largest dimension part, and the larger of the values is taken as the depth of the recess. The measurement thus discussed above is made of ten arbitrarily-selected recesses in the toilet paper surface, and the average is eventually taken as the embossing depth.

The area of each of the first and second recesses is also determined by visually confirming the contour of the recess in a 3D image obtained using Wide-Area 3D Measurement Microscope VR-3200 manufactured by KEYENCE CORPORATION or an equivalent thereof and an image analysis software VR-H1A manufactured by KEYENCE CORPORATION or an equivalent thereof, and determining the area inside the contour. This measurement is made of ten arbitrarily-selected recesses in the toilet paper surface, and the average is eventually taken as the area of one recess formed by embossing.

Figure 3:
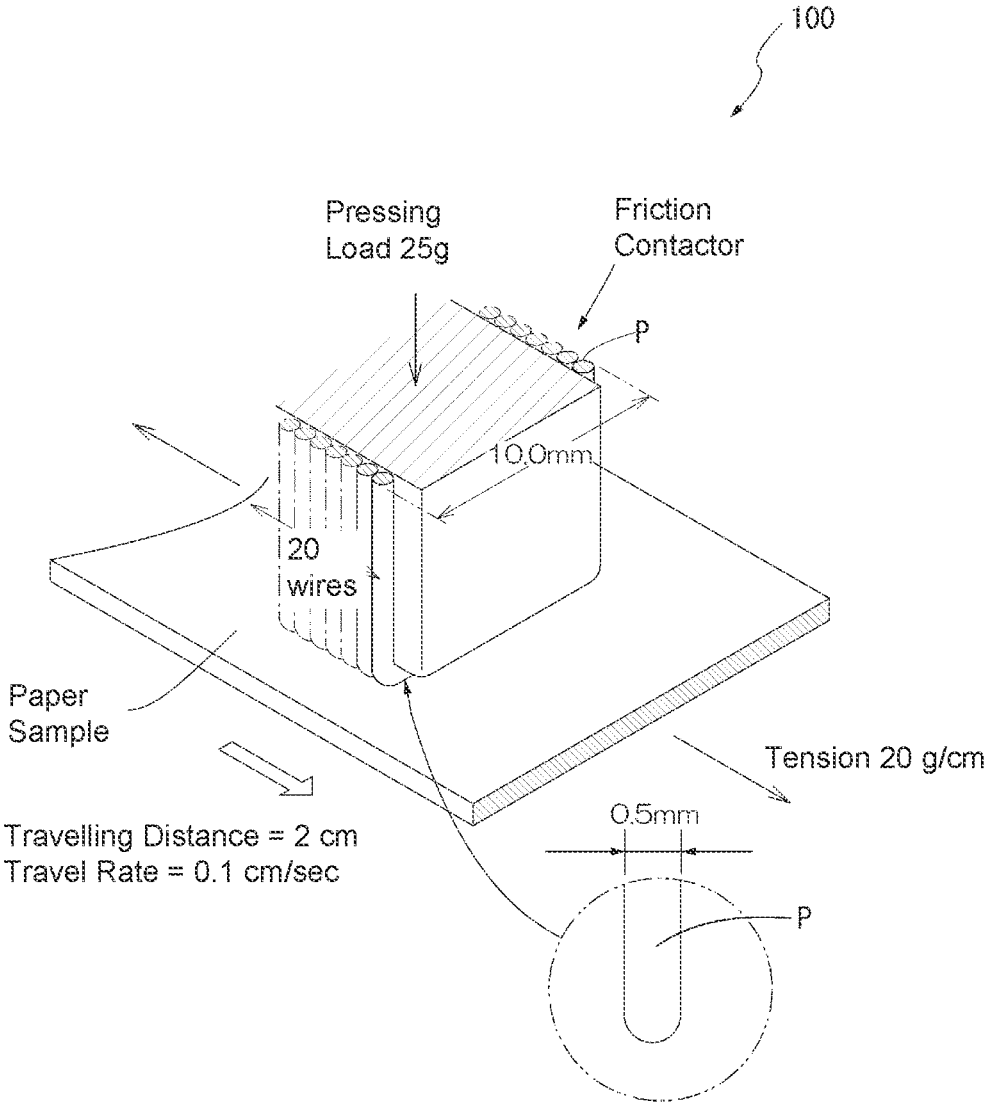
FIG. 3 is a schematic view for explaining how mean deviation of coefficient of friction (MMD) is measured according to the present invention.

In the toilet paper according to the present embodiment, the mean deviation of coefficient of friction (MMD) of the outer surface of the first ply in the laminate, where the first and second recesses are formed, is preferably 10.0 or less. In consideration of a feel on the skin of the toilet paper affected by the recesses, a more preferred MMD is 8.0 to 10.0. The MMD is determined using a measuring device 100 shown in FIG. 3. The contact surface of the friction contactor, while kept in contact at a contact pressure of 25 g with the surface of a sample under a tension of 20 g/cm in a predetermined direction, is moved in the direction approximately the same as the direction of the tension at a rate of 0.1 cm/s for 2 cm, and the coefficient of friction here is measured using a Friction Tester KES-SE manufactured by KATO TECH CO., LTD. or an equivalent thereof. The coefficient of friction divided by the distance of friction (travelling distance=2 cm) is the MMD. The friction contactor is composed of twenty piano wires of 0.5 mm diameter juxtaposed with each other, and has a contact surface of 10 mm in length and width. The contact surface is provided with a bulge unit formed with the twenty piano wires P (0.25 mm in radius of curvature) at the tip.

It is preferred with this toilet paper that the second ply also has recesses formed by embossing or the like. The second ply, having the recesses formed by embossing, has little difference in stretch from the first ply having the recesses and the projections, so that generation of creases or paper breakage during production may be avoided. Further, well-balanced thickness and texture, like softness, may easily be imparted to the toilet paper, which further facilitates production of the effects of the present invention. Note, however, that the area of each recess in the second ply is preferably smaller than the area of each first recess in the first ply and similar to the area of each second recess in the first ply. The density of the recesses formed by embossing in the second ply is preferably higher than that of the second recesses in the first ply. Specifically, the area of each recess in the second ply is preferably 0.25 to 0.75 $mm^2$, more preferably 0.30 to 0.50 $mm^2$. The density of the recesses formed by embossing in the second ply is preferably 2 to 12 recesses per square centimeter, more preferably 2 to 11 recesses per square centimeter, and still more preferably 4 to 8 recesses per square centimeter.

Further, the toilet paper preferably has a softness of 1.8 to 2.7 cN/100 mm, more preferably 2.0 to 2.6 cN/100 mm. The softness is determined by the Handle-O-Meter method in accordance with Method E in JIS L 1096 (2010).

With the MMD and the softness within the above-mentioned ranges, in combination with the features of the roll density and the roll winding density, the texture of the toilet paper and the texture of the roll surface according to the present embodiment are particularly improved.

On the other hand, in the toilet paper according to the present embodiment, preferably 55 mass % or more, more preferably 60 mass % to 70 mass % of the constituent fibers are pulp derived from hardwood. The pulp derived from hardwood is short in fiber length, and tends to improve formation of the paper surface. The toilet paper roll according to the present invention has a larger roll length and thus tends to give a feel of firmness, but with 55 mass % or more pulp derived from hardwood, the toilet paper roll may have improved smoothness and may be less likely to give a feel of firmness. The texture in use may also be improved. As the pulp derived from hardwood, there are known hardwood bleached kraft pulp (LBKP), hardwood unbleached kraft pulp (LUKP), hardwood oxygen-bleached kraft pulp (LOKP), and the like, and LBKP, which has been bleached, is preferred. Fibers other than the pulp derived from hardwood may preferably be pulp derived from softwood. In this case, softwood bleached kraft pulp (NBKP), which has been chlorine-bleached, is preferred.

It is preferred that a temporary wet paper strength agent and a dry paper strength agent are contained in or acted on the toilet paper according to the present embodiment. The dry paper strength agent improves dry tensile strength, and is likely to impart sufficient strength in use to paper and perforated lines. In addition, in winding a longer toilet paper around a paper core to produce a longer roll product, paper breakage may be hard to occur even at an elevated take-up tension during manufacture. Further, a higher dry tensile strength leads to a higher water absorption, but when the dry tensile strength is raised only with a dry paper strength agent, it is likely that the disintegration rate in water may be deteriorated, the paper may be too firm, and the texture and comfort in use may be poor. The temporary wet paper strength agent keeps the paper from being disintegrated by short contact with water in wiping, provides sufficient water disintegrability in a sufficient amount of water collected in the trap of a flushing toilet, and slightly lowers the paper strength compared to the strength of paper containing only a dry paper strength agent to enhance the texture. Accordingly, the temporary wet paper strength agent contained together with the dry paper strength agent may further enhance the texture as toilet paper and, in particular, give the toilet paper sufficient strength in wiping off water remaining on the skin after the use of shower toilet, a high water absorption with a sense of security, and hardness to allow penetration of water therethrough to the hand.

The content of the temporary wet paper strength agent is not necessarily limited, and may preferably be 0.01 to 0.04 mass %. It is preferred that the temporary wet paper strength agent is added internally during manufacture of the toilet paper. The temporary wet paper strength agent is not necessarily limited in type, and may be, for example, polyacrylamide resin, polyamide polyamine epichlorohydrin resin, urea resin, acid colloid-melamine resin, thermally cross-linkable coating PAM, TS-20 or TS 4070 manufactured by SEIKO PMC CORPORATION, polymeric aldehyde-functionalized compounds, such as glyoxylate polyacrylamide and cationic glyoxylated polyacrylamide, copolymers of acrylamide monomers modified with divalent aldehyde of glyoxal and other copolymerizable, unsaturated monomers, or dialdehyde starch.

The content of the dry paper strength agent is not necessarily limited, and may preferably be 0.005 to 0.15 mass %. This dry paper strength agent may preferably be added internally. The dry paper strength agent is not necessarily limited in type, and may be polyacrylamide, CMC (carboxymethyl cellulose), or salts thereof, such as sodium carboxymethyl cellulose, calcium carboxymethyl cellulose, or zinc carboxymethyl cellulose. On the other hand, starch and cationized starch tend to cause crispness and hard feel of the toilet paper surface, and are thus not preferred.

A particularly preferred dry paper strength agent is an enzymatic paper strength agent. Such an enzymatic paper strength agent has been particularly preferably acted on the toilet paper of the toilet paper roll according to the present embodiment. The enzymatic paper strength agent, unlike the paper strength agent which acts like an adhesive in imparting strength, such as starch, contains polysaccharide-degrading enzymes, which causes further fibrillation of the fibers to render the surface and interior of the fibers fuzzy. In this way, acting the enzymatic paper strength agent on the toilet paper will not hinder the hydrogen bonding, and increases the percentage of the cellulose fibers, so that, in combination with entangling of the fibers, in particular on their surfaces, the paper strength is enhanced. Further, the enzymatic paper strength agent thus enhances the paper strength but without hindering disintegrability of the toilet paper in water. Accordingly, the texture of the toilet paper is improved, and the toilet paper roll has excellent surface texture and water absorption, in particular, even with a larger roll length and higher roll density and roll winding density. Note that whether an enzymatic paper strength agent has been acted on the fibers or not may be confirmed by determining the presence of an enzymatic paper strength agent in toilet paper through high performance liquid chromatography (HPLC) or liquid chromatography mass spectrometry (LC/MS).

The enzymatic paper strength agent according to the present invention may contain at least one of cellulase, hemicellulase, and xylanase. Examples of the paper strength agent containing such enzymes may include HERCOBOND 8922 and HERCOBOND EZ4423, both manufactured by RIKEN GREEN CO. LTD.; Cellulosin T2 manufactured by HBI ENZYMES INC.; MEICELASE (registered trademark) manufactured by MEIJI SEIKA PHARMA CO., LTD.; NOVOZYME (registered trademark) 188 and CELL CRUST, both manufactured by NOVOZYMES; and MULTIFECT CX10L/B/GCc/GC/PECTINASE (hemicellulase), SPEZYME CP, and GC220, all manufactured by GENENCOR. The amount of the enzymatic paper strength agent to be added is not limited, and may preferably be 0.5 to 2.0 kg/t.

The dry tensile strength of the toilet paper according to the present embodiment is not limited, and may be 400 cN/25 mm to 600 cN/25 mm, preferably 450 cN/25 mm to 580 cN/25 mm in longitudinal direction, and 100 cN/25 mm to 200 cN/25 mm, preferably 135 cN/25 mm to 180 cN/25 mm in horizontal direction. Here, the longitudinal direction of paper is also referred to as the machine direction (MD) thereof, which is the flow direction in papermaking. The horizontal direction of paper is also referred to as the cross direction (CD) thereof, which is the direction orthogonal to the flow direction (MD) in papermaking. As used herein, the dry tensile strength is measured in accordance with JIS P 8113 (2006), and determined as follows. A test piece is cut out in about 25 mm (±0.5 mm) wide by 150 mm long size for testing in each of the longitudinal and horizontal directions. The test piece is subjected to measurement as it is in a plurality of plies. As the tester, load cell-type Tensile Testing Machine TG-200N manufactured by MINEBEA CO., LTD. or an equivalent thereof may be used. The chuck distance is set to 100 mm, and the tension speed to 100 mm/min. The measurement is made by clamping the test piece at both ends with the chucks of the tester, applying a tensile load to the piece of paper in the vertical direction, and reading the indicator (digital value) at break of the paper. Five measurements are made with five samples in each of the longitudinal and horizontal directions, and the average of the measured values in each direction is taken as the dry tensile strength in that direction.

The wet tensile strength of the toilet paper according to the present embodiment may be 20 cN/25 mm to 60 cN/25 mm, preferably 30 cN/25 mm to 55 cN/25 mm in the longitudinal direction, and preferably 10 cN/25 mm to 30 cN/25 mm in the horizontal direction. The wet tensile strength is measured in accordance with JIS P 8135 (1998), and determined as follows. A test piece is cut out in about 25 mm (±0.5 mm) wide by 150 mm long size for testing in each of the longitudinal and horizontal directions. The toilet paper is subjected to measurement in a plurality of plies, when it is. As the tester, load cell-type Tensile Testing Machine TG-200N manufactured by MINEBEA CO., LTD. or an equivalent thereof may be used. The chuck distance is set to 100 mm, and the tension rate to 50 mm/min. The test piece is subjected to curing in a dryer at 105° C. for 10 minutes in advance. The measurement is made by clamping the test piece at both ends with the chucks of the tester, horizontally applying water along the center of the test piece in an about 10 mm width using a moistened flat brush, then immediately applying a tensile load to the piece of paper in the vertical direction, and reading the indicator (digital value) at break of the paper. Five measurements are made with five samples in each of the longitudinal and horizontal directions, and the average of the measured values in each direction is taken as the wet tensile strength in that direction.

The toilet paper according to the present embodiment may have a disintegration rate in water within 60 seconds, preferably 45 to 20 seconds. With a disintegration rate within 60 seconds, the toilet paper may have little risk of clogging piping when flushed down a flushing toilet. With a disintegration rate of 20 seconds or more, the toilet paper may have little risk of breaking by immediate loosening of its fibers, even in wiping off a quantity of moisture after use of a shower toilet. The disintegration rate in water (easiness to loosen) is determined in accordance with JIS P 4501 (1993). The easiness to loosen may be tested by placing a 300 mL beaker containing 300 mL of water (at 20±5° C.) on a magnetic stirrer, and adjusting the rotation speed of the rotor to 600±10 rpm. A test piece of 100±2 mm square is introduced into the beaker, and a stopwatch is started. The rotation speed of the rotor first declines to about 500 rpm due to resistance of the test piece, and then increases as the test piece is loosened. When this rotation speed is recovered to 540 rpm, the stopwatch is stopped, and the time period is determined in seconds. The result of easiness to loosen is represented by the average of the results of five tests. The rotor is in the form of a disk of 35 mm in diameter and 12 mm in thickness.

Preferably, the number of penetrable sheets of the toilet paper according to the present embodiment is nine or more. The number of penetrable sheets may be determined by stacking a plurality of sheets of toilet paper under its own weight only, dripping 100 μL of water from 10 mm above the uppermost toilet paper sheet and, immediately after the dripping, checking the stack for water penetration down to the lowermost sheet. The test is started with a small number of stacked sheets, and the number of the sheets is increased until the penetration is not observed, to determine the maximum number of sheets through which the penetration is observed. It may be said that penetration of water through nine or more sheets means quite a quick penetration.

Further, it is preferred that the toilet paper according to the present embodiment is provided with perforated lines at predetermined longitudinal intervals. Each interval is not limited, and may be 100 to 120 mm. The strength of the perforated lines may preferably be 580 to 700 cN/114 mm. The strength of the perforated lines is determined in accordance with the measurement of the dry tensile strength according to JIS P 8113 (2006). A sample for the measurement is taken from toilet paper in a product form so that the length is 200 mm, the width corresponds to the full width of the toilet paper product, and a perforated line is positioned on the longitudinal center of the sample. For the measurement, the sample is folded in double or fourth along the longitudinal direction (corresponding to the MD axis) to have a width that may be clamped with the chucks of the tensile tester, and the measurement is made with a chuck distance of 100 mm at a tension rate of 100 mm/min. Five measurements are made, and the measured values are converted in terms of 114 mm width, and the average of the converted values is taken as the strength of the perforated lines. As the tester, load cell-type Tensile Testing Machine TG-200N manufactured by MINEBEA CO., LTD. or an equivalent thereof may be used.

EXAMPLES

In Examples of the toilet paper roll according to the present invention and its Comparative Examples, physical properties, such as the disintegration rate in water and the number of penetrable sheets, as well as the composition were determined, and sensory assessments were made on "Feel of Robustness of Roll (Roll Firmness)", "Feel of Roll Surface", "Routine Frequency of Roll Change", "Feel of Thickness of Toilet Paper (Sense of Security in Use)", "Softness of Toilet Paper", "Fluffiness of Toilet Paper", "Smoothness of Toilet Paper", and "Feel of Wiping with Toilet Paper". The sensory assessments were made by 20 panels, who actually used the toilet paper rolls and evaluated each item. The assessments were made with reference to a reference sample in Comparative Example 1, which was a conventional 2-ply common product. The assessments were scored in seven grades, with the reference sample scored as 4 points. A sample is scored as 7 points when particularly good, as 6 points when good, as 5 points when slightly good, as 3 points when slightly bad, as 2 points when bad, and as 1 point when particularly bad, compared to the reference sample, and the average was taken. With regard to the "Feel of Robustness of Roll (Roll Firmness)", samples firmer than the reference sample were scored higher, and samples softer than the reference sample were scored lower.

In Examples and Comparative Examples, toilet paper was used in which the first ply having the first and second recesses in the same surface were laminated together with the second ply into a 2-ply toilet paper, with the surface having the first and second recesses facing externally of the laminate. In the second ply were formed recesses having shape and depth similar to those of the second recesses in the first ply. The shapes of the first and second recesses were the same in Examples 1 to 7, Comparative Examples 1 and 4 to 7, whereas the shapes of the first and second recesses were the same in Comparative Examples 2 and 3.

In each of Examples and Comparative Examples, a paper strength agent was used. In Examples 1 to 7 and Comparative Examples 4 to 7, an enzymatic paper strength agent (HERCOBOND 8922 manufactured by RIKEN GREEN CO., LTD.) was used as a dry paper strength agent, and a temporary paper strength agent (TS4070 manufactured by SEIKO PMC CORPORATION) was used. In Comparative Example 1, a cationized starch (DD4280 manufactured by SEIKO PMC CORPORATION) was used as a dry paper strength agent, and a temporary paper strength agent (TS4070 manufactured by SEIKO PMC CORPORATION) was used.

Other physical properties and the composition of each of Examples and Comparative Examples are shown in Table 1 below. The methods of measurements were as discussed above.

TABLE 1

| | | | | Ex. 1 | Ex. 2 | Ex. 3 | Ex. 4 |
|---|---|---|---|---|---|---|---|
| Base Paper | Pulp Raw Material | NBKP | % | 37 | 37 | 37 | 37 |
| | | LBKP | % | 63 | 63 | 63 | 63 |
| | Internally-added Chemical | Cationized Starch | kg/t | — | — | — | — |
| | | Enzymatic Dry Paper Strength Agent | kg/t | 1.0 | 1.0 | 1.5 | 2.0 |
| | | Temporary Wet Paper Strength Agent | kg/t | 0.4 | 0.2 | 0.2 | 0.2 |
| Product | Roll Length | | m | 46 | 46 | 38 | 46 |
| | Roll Diameter | | mm | 115 | 118.5 | 118.0 | 116.0 |
| | Basis Weight | | $g/m^2$ | 14.5 | 13.9 | 15.3 | 14.6 |
| | Paper Thickness (2P) | | μm | 200 | 188 | 223 | 210 |
| | Dry Paper Strength | Longitudinal | cN/25 mm | 500 | 525 | 550 | 560 |
| | | Horizontal | cN/25 mm | 150 | 150 | 160 | 161 |
| | Wet Paper Strength | Longitudinal | cN/25 mm | 50 | 33 | 35 | 42 |
| | | Horizontal | cN/25 mm | 15 | 12 | 12 | 13 |
| | Strength of Perforated Line | | cN/114 mm | 600 | 610 | 635 | 655 |
| | MMD | | — | 9.4 | 9.0 | 9.5 | 9.7 |
| | Softness | | cN/100 mm | 2.1 | 2.2 | 2.3 | 2.4 |
| | Disintegration Rate in Water | | second | 50 | 35 | 36 | 38 |
| | Number of Penetrable Sheets | | sheet | 9 | 9 | 8 | 8 |
| | Roll Width | | mm | 110 | 110 | 110 | 110 |
| | Paper Core Diameter | | mm | 38 | 38 | 38 | 38 |
| | Roll Winding Density | | $m/cm^2$ | 0.99 | 0.93 | 0.78 | 0.98 |
| | Roll Density | | $g/cm^3$ | 0.14 | 0.13 | 0.12 | 0.14 |
| | Degree of Compaction of Roll | | | 0.99 | 0.81 | 0.67 | 1.00 |
| | Embossing | | | 1st + 2nd | 1st + 2nd | 1st + 2nd | 1st + 2nd |
| | First Recess | Recess Depth | mm | 0.22 | 0.18 | 0.22 | 0.22 |
| | | Recess Diameter | mm | 1.5 × 1.5 | 1.5 × 1.5 | 1.5 × 1.5 | 1.5 × 1.5 |
| | | Recess Area | $mm^2$ | 1.8 | 1.8 | 1.8 | 1.8 |
| | Second Recess | Recess Depth | mm | 0.074 | 0.054 | 0.064 | 0.085 |
| | | Recess Diameter | mm | 0.7 × 0.7 | 0.7 × 0.7 | 0.7 × 0.7 | 0.7 × 0.7 |
| | | Recess Area | $mm^2$ | 0.4 | 0.4 | 0.4 | 0.4 |
| Evaluation in Use | | Feel of Robustness of Roll | | 6.2 | 6.0 | 6.1 | 6.0 |
| | | Feel of Roll Surface | | 5.5 | 6.0 | 6.0 | 6.3 |
| | | Routine Frequency of Roll Change | | 6.5 | 6.5 | 6.5 | 6.5 |
| | | Feel of Thickness (Sense of Security in Use) | | 4.2 | 4.1 | 4.2 | 4.4 |
| | | Softness | | 4.5 | 4.5 | 4.3 | 4.4 |
| | | Fluffiness | | 4.1 | 4.1 | 4.1 | 4.2 |
| | | Smoothness | | 5.1 | 5.2 | 5.1 | 5.0 |
| | | Feel of Wiping | | 4.5 | 4.3 | 4.4 | 4.5 |

TABLE 1-continued

| | | | | Ex. 5 | Ex. 6 | Ex. 7 |
|---|---|---|---|---|---|---|
| Base Paper | Pulp Raw Material | NBKP | % | 37 | 37 | 37 |
| | | LBKP | % | 63 | 63 | 63 |
| | Internally-added Chemical | Cationized Starch | kg/t | — | — | — |
| | | Enzymatic Dry Paper Strength Agent | kg/t | 0.8 | 1.5 | 1.0 |
| | | Temporary Wet Paper Strength Agent | kg/t | 0.4 | 0.4 | 0.4 |
| Product | Roll Length | | m | 46 | 46 | 50 |
| | Roll Diameter | | mm | 115.4 | 114.8 | 107.4 |
| | Basis Weight | | $g/m^2$ | 15.7 | 14.4 | 13.8 |
| | Paper Thickness (2P) | | μm | 217 | 210 | 182 |
| | Dry Paper Strength | Longitudinal | cN/25 mm | 500 | 544 | 555 |
| | | Horizontal | cN/25 mm | 145 | 156 | 160 |
| | Wet Paper Strength | Longitudinal | cN/25 mm | 51 | 54 | 54 |
| | | Horizontal | cN/25 mm | 16 | 16 | 16 |
| | Strength of Perforated Line | | cN/114 mm | 600 | 650 | 650 |
| | MMD | | — | 8.9 | 9.6 | 9.6 |
| | Softness | | cN/100 mm | 2.1 | 2.4 | 2.4 |
| | Disintegration Rate in Water | | second | 47 | 52 | 52 |
| | Number of Penetrable Sheets | | sheet | 9 | 8 | 8 |
| | Roll Width | | mm | 110 | 110 | 110 |
| | Paper Core Diameter | | mm | 38 | 38 | 38 |
| | Roll Winding Density | | $m/cm^2$ | 0.99 | 1.00 | 1.26 |
| | Roll Density | | $g/cm^3$ | 0.15 | 0.14 | 0.17 |
| | Degree of Compaction of Roll | | | 1.06 | 1.05 | 1.45 |
| | Embossing | | | 1st + 2nd | 1st + 2nd | 1st + 2nd |
| | First Recess | Recess Depth | mm | 0.19 | 0.21 | 0.18 |
| | | Recess Diameter | mm | 1.5 × 1.5 | 1.5 × 1.5 | 1.5 × 1.5 |
| | | Recess Area | $mm^2$ | 1.8 | 1.8 | 1.8 |
| | Second Recess | Recess Depth | mm | 0.082 | 0.069 | 0.077 |
| | | Recess Diameter | mm | 0.7 × 0.7 | 0.7 × 0.7 | 0.7 × 0.7 |
| | | Recess Area | $mm^2$ | 0.4 | 0.4 | 0.4 |
| Evaluation in Use | | Feel of Robustness of Roll | | 5.9 | 6.1 | 6.5 |
| | | Feel of Roll Surface | | 5.8 | 6.1 | 5.7 |
| | | Routine Frequency of Roll Change | | 6.5 | 6.6 | 6.6 |
| | | Feel of Thickness (Sense of Security in Use) | | 4.2 | 4.5 | 4.5 |
| | | Softness | | 4.4 | 4.4 | 4.4 |
| | | Fluffiness | | 4.0 | 4.2 | 4.2 |
| | | Smoothness | | 5.0 | 4.9 | 4.9 |
| | | Feel of Wiping | | 4.4 | 4.6 | 4.6 |

| | | | | Comp. Ex. 1 | Comp. Ex. 2 | Comp. Ex. 3 | Comp. Ex. 4 |
|---|---|---|---|---|---|---|---|
| Base Paper | Pulp Raw Material | NBKP | % | 37 | — | — | 37 |
| | | LBKP | % | 63 | — | — | 63 |
| | Internally-added Chemical | Cationized Starch | kg/t | 15 | — | — | — |
| | | Enzymatic Dry Paper Strength Agent | kg/t | 0.5 | — | — | 1.5 |
| | | Temporary Wet Paper Strength Agent | kg/t | — | — | — | 0.3 |
| Product | Roll Length | | m | 23 | 24 | 35 | 50 |
| | Roll Diameter | | mm | 106 | 108 | 116.5 | 105 |
| | Basis Weight | | $g/m^2$ | 15.0 | 16.4 | 16.2 | 14.3 |
| | Paper Thickness (2P) | | μm | 240 | 331 | 243 | 185 |
| | Dry Paper Strength | Longitudinal | cN/25 mm | 500 | 619 | 730 | 520 |
| | | Horizontal | cN/25 mm | 150 | 131 | 195 | 150 |
| | Wet Paper Strength | Longitudinal | cN/25 mm | 50 | 40 | 51 | 35 |
| | | Horizontal | cN/25 mm | 15 | 11 | 12 | 12 |
| | Strength of Perforated Line | | cN/114 mm | 600 | 689 | 900 | 612 |
| | MMD | | — | 7.5 | 13.4 | 10.3 | 9.0 |
| | Softness | | cN/100 mm | 1.7 | 3.42 | 3.34 | 2.0 |
| | Disintegration Rate in Water | | second | 40 | 22 | 61 | 38 |
| | Number of Penetrable Sheets | | sheet | 9 | 7 | 7 | 10 |
| | Roll Width | | mm | 114 | 114 | 114 | 110 |
| | Paper Core Diameter | | mm | 41 | 37 | 37 | 38 |
| | Roll Winding Density | | $m/cm^2$ | 0.61 | 0.59 | 0.73 | 1.33 |
| | Roll Density | | $g/cm^3$ | 0.09 | 0.10 | 0.12 | 0.19 |
| | Degree of Compaction of Roll | | | 0.45 | 0.58 | 0.65 | 1.63 |
| | Embossing | | | 1st + 2nd | 1st + 2nd | 1st + 2nd | 1st + 2nd |
| | First Recess | Recess Depth | mm | 0.24 | 0.31 | 0.24 | 0.14 |
| | | Recess Diameter | mm | 1.5 × 1.5 | 1.7 × 0.9 | 1.7 × 0.9 | 1.5 × 1.5 |
| | | Recess Area | $mm^2$ | 1.8 | 1.2 | 1.2 | 1.8 |
| | Second Recess | Recess Depth | mm | 0.088 | 0.165 | 0.120 | 0.045 |
| | | Recess Diameter | mm | 0.7 × 0.7 | 0.5 × 0.5 | 0.5 × 0.5 | 0.7 × 0.7 |
| | | Recess Area | $mm^2$ | 0.4 | 0.2 | 0.2 | 0.4 |

TABLE 1-continued

| | | | | | |
|---|---|---|---|---|---|
| Evaluation in Use | Feel of Robustness of Roll | 4.0 | 4.8 | 5.7 | 6.3 |
| | Feel of Roll Surface | 4.0 | 3.6 | 3.8 | 6.4 |
| | Routine Frequency of Roll Change | 4.0 | 4.0 | 4.7 | 6.5 |
| | Feel of Thickness (Sense of Security in Use) | 4.0 | 3.8 | 4.3 | 4.1 |
| | Softness | 4.0 | 3.5 | 3.6 | 4.3 |
| | Fluffiness | 4.0 | 3.4 | 3.2 | 3.9 |
| | Smoothness | 4.0 | 3.3 | 3.1 | 5.3 |
| | Feel of Wiping | 4.0 | 3.4 | 3.3 | 4.2 |

| | | | | Comp. Ex. 5 | Comp. Ex. 6 | Comp. Ex. 7 |
|---|---|---|---|---|---|---|
| Base Paper | Pulp Raw Material | NBKP | % | 37 | 37 | 37 |
| | | LBKP | % | 63 | 63 | 63 |
| | Internally-added Chemical | Cationized Starch | kg/t | — | — | — |
| | | Enzymatic Dry Paper Strength Agent | kg/t | 1.4 | 1.3 | 1.3 |
| | | Temporary Wet Paper Strength Agent | kg/t | 0.3 | 0.3 | 0.4 |
| Product | Roll Length | | m | 48 | 37 | 36 |
| | Roll Diameter | | mm | 104 | 120 | 118.5 |
| | Basis Weight | | $g/m^2$ | 14.5 | 14.7 | 15.0 |
| | Paper Thickness (2P) | | μm | 181 | 215 | 215 |
| | Dry Paper Strength | Longitudinal | cN/25 mm | 530 | 532 | 555 |
| | | Horizontal | cN/25 mm | 155 | 155 | 158 |
| | Wet Paper Strength | Longitudinal | cN/25 mm | 34 | 38 | 41 |
| | | Horizontal | cN/25 mm | 13 | 16 | 17 |
| | Strength of Perforated Line | | cN/114 mm | 620 | 622 | 645 |
| | MMD | | — | 9.4 | 9.8 | 9.9 |
| | Softness | | cN/100 mm | 2.0 | 2.3 | 2.3 |
| | Disintegration Rate in Water | | second | 40 | 45 | 48 |
| | Number of Penetrable Sheets | | sheet | 9 | 8 | 7 |
| | Roll Width | | mm | 110 | 110 | 110 |
| | Paper Core Diameter | | mm | 38 | 38 | 38 |
| | Roll Winding Density | | $m/cm^2$ | 1.30 | 0.73 | 0.73 |
| | Roll Density | | $g/cm^3$ | 0.19 | 0.11 | 0.11 |
| | Degree of Compaction of Roll | | | 1.54 | 0.57 | 0.57 |
| | Embossing | | | 1st + 2nd | 1st + 2nd | 1st + 2nd |
| | First Recess | Recess Depth | mm | 0.15 | 0.26 | 0.27 |
| | | Recess Diameter | mm | 1.5 × 1.5 | 1.5 × 1.5 | 1.5 × 1.5 |
| | | Recess Area | $mm^2$ | 1.8 | 1.8 | 1.8 |
| | Second Recess | Recess Depth | mm | 0.048 | 0.090 | 0.094 |
| | | Recess Diameter | mm | 0.7 × 0.7 | 0.7 × 0.7 | 0.7 × 0.7 |
| | | Recess Area | $mm^2$ | 0.4 | 0.4 | 0.4 |
| Evaluation in Use | Feel of Robustness of Roll | | | 6.2 | 4.8 | 4.7 |
| | Feel of Roll Surface | | | 6.3 | 5.5 | 5.4 |
| | Routine Frequency of Roll Change | | | 6.5 | 4.7 | 4.6 |
| | Feel of Thickness (Sense of Security in Use) | | | 4.1 | 4.2 | 4.2 |
| | Softness | | | 4.3 | 4.4 | 4.4 |
| | Fluffiness | | | 3.8 | 4.2 | 4.2 |
| | Smoothness | | | 5.2 | 4.7 | 4.7 |
| | Feel of Wiping | | | 4.2 | 4.3 | 4.3 |

As the results shown in Table 1, the "Feel of Robustness of Roll (Roll Firmness)" tended to be higher as the roll length was larger. In Examples according to the present invention, the rolls had larger roll lengths and were evaluated as giving a feel of more robust firmness, compared to the rolls of Comparative Examples 1 to 3. Nevertheless, the rolls of Examples were evaluated higher in feel of roll surface, compared to the rolls of Comparative Examples 1 to 3.

Further, the rolls of Examples exhibited better results in all of the items related to the texture of the toilet paper, i.e., "Feel of Thickness (Sense of Security in Use) of Toilet Paper", "Softness of Toilet Paper", "Fluffiness of Toilet Paper", "Smoothness of Toilet Paper", and "Feel of Wiping with Toilet Paper", compared to the rolls of Comparative Examples 1 to 3 having shorter roll lengths and wound loosely.

The rolls of Comparative Examples 4 to 7 were evaluated somewhat lower, compared to the rolls of Examples 1 to 7 according to the present invention.

That is, in Examples according to the present invention, the toilet papers were capable of wiping off water remaining on the skin, highly water-absorbent, provided a sense of security in wiping, and had sufficient texture, such as softness, fluffiness, and smoothness, and the toilet paper rolls had a feel of robust firmness while giving excellent comfortable touch of roll surfaces.

DESCRIPTION OF REFERENCE SIGNS

1: toilet paper roll
10: toilet paper
20: paper core (paper tube)
L1: roll diameter (diameter) of toilet paper roll
L3: diameter of paper core of toilet paper roll
L2: width of toilet paper roll

The invention claimed is:

1. A toilet paper roll comprising a paper core and 2-ply toilet paper wound thereon, wherein the toilet paper roll has a roll diameter of 120 mm or smaller, a roll length of 34.5 to 50 m, a roll winding density of 0.74 to 1.30 $m/cm^2$, and a roll density of 0.12 to 0.18 $g/cm^3$, wherein the 2-ply toilet paper has a basis weight per ply of 13.5 g/m$^2$ to 16.0 g/m$^2$, and a paper thickness in 2 ply of 180 to 225 μm, wherein the 2-ply toilet paper has first and second plies laminated together, where the first ply includes first recesses and second recesses, wherein the first recesses and the second recesses are formed by embossing, wherein the first recesses have a depth and the second recesses have a depth, and wherein the depth of the first recesses is different than the depth of the second recesses, wherein an area of each recess of the first recesses is 1.00 to 22.0 mm$^2$, and wherein an area of each recess of the second recesses is 0.25 to 0.75 mm$^2$, wherein a density of the first recesses is 4 to 14 recesses per square centimeter, and wherein a density of the second recesses is 2 to 11 recesses per square centimeter, and wherein an inner surface portion of the first ply corresponding to the plurality of first recesses is adhered to an inner surface of the second ply, and wherein the inner surface portion of the first ply corresponding to the second recesses is not adhered with an adhesive on the inner surface of the second ply.

2. The toilet paper roll according to claim 1, wherein a degree of compaction of the toilet paper roll is 0.66 to 1.50.

3. The toilet paper roll according to claim 1, wherein the second ply has recesses formed by embossing, wherein said recesses of said second ply have a smaller depth compared to the depth of the first recesses in the first ply.

4. The toilet paper roll according to claim 1, wherein an enzymatic paper strength agent has been acted on the 2-ply toilet paper.

5. The toilet paper roll according to claim 1, wherein the 2-ply toilet paper is free of starch and cationized starch.

* * * * *